US008926230B2

(12) United States Patent
Tadolini et al.

(10) Patent No.: US 8,926,230 B2
(45) Date of Patent: Jan. 6, 2015

(54) TENSION CABLE BOLT

(71) Applicants: Stephen C. Tadolini, St. Clairsville, OH (US); Larry B. McKinney, Beckley, WV (US)

(72) Inventors: Stephen C. Tadolini, St. Clairsville, OH (US); Larry B. McKinney, Beckley, WV (US)

(73) Assignee: Minova USA, Inc., Georgetown, KY (US)

( * ) Notice: Subject to any disclaimer, the term of this patent is extended or adjusted under 35 U.S.C. 154(b) by 13 days.

(21) Appl. No.: 13/649,471

(22) Filed: Oct. 11, 2012

(65) Prior Publication Data

US 2014/0105690 A1 Apr. 17, 2014

(51) Int. Cl.
*E21D 20/00* (2006.01)
*E21D 21/00* (2006.01)

(52) U.S. Cl.
CPC ..... *E21D 21/008* (2013.01); *E21D 20/00* (2013.01); *E21D 2021/006* (2013.01)
USPC ..... 405/302.1; 405/302.2

(58) Field of Classification Search
USPC ..... 405/302.1, 302.2; 403/367
See application file for complete search history.

(56) References Cited

U.S. PATENT DOCUMENTS

| | | | | |
|---|---|---|---|---|
| 5,511,909 | A * | 4/1996 | Calandra et al. | 405/259.6 |
| 5,525,013 | A * | 6/1996 | Seegmiller et al. | 405/259.3 |
| 5,531,545 | A * | 7/1996 | Seegmiller et al. | 405/259.4 |
| 6,322,290 | B1 * | 11/2001 | Calandra et al. | 405/259.1 |
| 7,625,155 | B1 * | 12/2009 | McKinney et al. | 405/302.2 |
| 8,033,760 | B2 * | 10/2011 | Hinton et al. | 405/302.2 |

* cited by examiner

*Primary Examiner* — Tara M. Pinnock
(74) *Attorney, Agent, or Firm* — Dickinson Wright PLLC

(57) ABSTRACT

A low profile tensionable bolt cable system and method of installation. The tensionable bolt cable has a tension cylinder with a constant diameter throughout its length and a threaded exterior. A bearing plate is provided with an opening and a first mating member. The tension cylinder has a proximal and a distal end with the proximal end having an angled interior surface and a longitudinally extending second mating member. The first and second mating members mate when the tension cylinder is inserted into the bearing plate. Angled wedges are inserted into the angled interior surface. A cable is inserted into the tension cylinder and between the wedges to hold the cable with respect to the tension cylinder to prevent the cable from twisting. A nut is threaded onto the tension cylinder, to tension the cable.

14 Claims, 6 Drawing Sheets

TENSION CABLE BOLT

BACKGROUND OF THE INVENTION

As is well known in the mining industry, there are numerous apparatus and methods used in rock bolting for strata control. An internationally accepted method of strata control is full column resin bolting which provides rapid and effective strata control at relatively lower cost than traditional external set supports.

Resin-anchored cable bolts are generally defined as "active methods" of support. These active reinforcing methods are intended to react to rock mass movement, develop a restraining force and transfer that force back to the rock mass. This counteracts the driving force and eventually results in a balanced condition when the total mobilized resistance within the rock mass is at least equal to the available driving force.

Resin anchored cable bolts can be installed as either passive or post-tensioned supports. In tensioning applications, standard cable heads, low-profile heads, barrels and wedges, can be used to tension the cable.

Typically, resin anchored cable bolts require a borehole to be drilled in the mine surface, such as a roof or wall. A resin cartridge is inserted into the borehole and then the cable bolt is inserted and rotated to rupture the resin cartridge. The cable bolt will typically have a roof plate mounted upon the cable bolt, a barrel and wedge assembly mounted to the end of the cable bolt and a drive head, typically a nut, that can be rotated with typical mine roof bolt installation equipment. The nut is rotated to drive the barrel and wedge assembly against the roof plate and mine surface to tension the cable.

U.S. Pat. No. 6,074,134 discloses an example of cable bolt assembly.

One disadvantage of the cable bolt of the '134 patent is that the cable twists during tensioning. It has been found to be advantageous to restrain twisting of the cable bolt during tensioning. When tensioning a steel cable, it is not uncommon for the cable itself to twist between the point of application of torque for tensioning and the point at which the cable is cemented in place. This can cause a decrease in the length of the cable. Upon release of the drive equipment, the cable can untwist thereby returning to its longer length and causing an undesirable decrease in the tension on the cable.

Another problem with this cable bolt assembly is that the barrel and wedge assembly is fairly large and extends into the mine area, which can be a problem in small spaces where space is at a premium. Additionally, the barrel and wedge assemblies are costly to manufacture and adds cost to the cable bolt.

U.S. Pat. No. 8,033,760 discloses another example of a resin anchored cable bolt. As stated in the abstract, a tensioning assembly 10 for a cable bolt 11 comprises a clamping device (14, 16) adapted for fastening to the bolt and an outer member 18 adapted for interacting with the clamping device. The outer member 18 is able to undergo relative movement with respect to the clamping device in the direction of the bolt's axis, and under such movement, the clamping device is caused to fasten to the bolt. Furthermore, the outer member is adapted for interacting with the bolt 11 whereby, during such relative movement, twisting of the bolt 11 with respect to the outer member 18 is restrained.

A problem with this cable bolt assembly is the complexity of the clamping device and the outer member. This adds cost to the cable bolt assembly. Also, the clamping device and outer member is large and extends into the mine area, which can be a problem in small spaces where space is at a premium.

Australian patent application 2008100948 discloses a cable bolt assembly that includes a tensioning device having a strata plate, a barrel fitting for attaching a cable and a barrel actuator. The tensioning device includes an engaging means for interlocking the barrel fitting and the strata plate to prevent rotation of the barrel fitting and the cable relative to the strata plate. The locking means is disclosed to be a pin or rod configured for engagement with a mating hole in the barrel fitting. In an alternative embodiment, the locking means may be an adhesive. In the preferred embodiment, the pin or rod is in the form of a shear pin designed to break or fracture at a predetermined load to them permit longitudinal movement of the barrel actuator relative to the barrel fitting. The barrel fitting also includes a thrust bearing configured to engage a domed washer to prevent rotational movement while permitting relative longitudinal movement.

This cable bolt assembly suffers from the same disadvantages as the previously discussed cable bolt assemblies.

U.S. Pat. No. 7,625,155 discloses a cable bolt assembly which includes tension cylinders and tension nuts, alone or in combination with cables and roof bearing plates, for use in underground mines to support mine roofs. The cables have a first end that is secured within a borehole in a roof, a second end for exposure from the borehole, and a weight bearing nut secured to the second end. The tension cylinder accommodates, yet is not affixed to, the cable, and includes a threaded exterior surface and an interior cable-accommodating channel. The tension nut has a threaded interior surface complementary to the threaded exterior surface of the tension cylinder, and is rotatable about the tension cylinder. The assembly with the cable and roof bearing plate are positioned within the borehole so that the tension cylinder is within and extends beyond the aperture of the roof bearing plate, and rests against the weight bearing nut of the cable. As the tension nut is rotated about the tension cylinder, and until the nut has compressed the roof bearing plate against the mine roof, the cable does not rotate or twist.

One of the problems with the '155 system is the requirement that the weight bearing nut be secured to the end of the cable. It is not disclosed in the patent the method of attaching the weight bearing nut, but it would seem to require either welding or the use of a barrel and wedge assembly. Regardless, there is added cost to the system. Additionally, if welded, the tension cylinder, tension nut and roof bearing plate has to be pre-assembled on the cable bolt. This adds to shipping costs and handling problems. Also, as with previous systems, the cable bolt of the '155 patent is large and extends into the mine area, taking up valuable space.

United States Application 20090191007 discloses a mixing and tensioning assembly having a cable bolt, an integral body of a wedge barrel and threaded sleeve disposed about the cable bolt, a nut disposed along the integral body and a bearing plate. While the preferred embodiment contemplates the integral body being a continual unitary member, a person of skill in the art would recognize that other embodiments would contemplate an interface between a wedge barrel and a threaded sleeve achieved via a weld between a wedge barrel and a threaded sleeve, via a recessed barrel with a mating surface corresponding to a mating end of a threaded sleeve, via screwing the threaded sleeve into the wedge barrel, or via prongs on one end of the threaded sleeve engaging apertures in the wedge barrel, all to fix the interrelationship between the wedge barrel and the threaded sleeve. The result in all embodiments is an interdependent wedge barrel and threaded sleeve which when either part is acted upon by a force the same or substantially similar force is also transmitted to the other part of the integral body.

There are also opposing and mating shapes in the aperture of the bearing plate and the threaded member to permit the threaded member to slide through the aperture of the plate but also reduce or prevent the threaded member from spinning within the aperture of the bearing plate.

The cable bolt assembly of United States Application 20090191007 has the same disadvantages of the previous cable bolt assemblies, in that it employs a typical wedge and barrel assembly to engage and hold the cable. The wedge and barrel assembly is fairly large and extends into the mine area, which can be a problem in small spaces where space is at a premium. Still further, the barrel and wedge assemblies are costly to manufacture and adds cost to the cable bolt. Additionally, the nut, washers and plate have to be assembled on the integral body prior to the integral body being inserted over the cable. This increases the labor required to install the cable bolt.

SUMMARY OF THE INVENTION

The present invention overcomes the disadvantages of the known cable bolt assemblies by providing a tensionable cable bolt assembly having a unitary tension cylinder with a constant outside diameter and an internal angled bore for receipt of wedges. The exterior of the cylinder is threaded for receipt of a nut. Mating surfaces are provided in the exterior of the cylinder and the bearing plate to prevent the cylinder and the cable that is captured by the wedges in the cylinder from rotating with respect to the bearing plate and to prevent the cable from twisting.

The present invention is inexpensive to manufacture, since there is only a cylinder with a constant diameter and an internal bore with an angled surface. The tension cylinder of the present invention eliminates the need for a wedge and barrel assembly. This greatly reduces costs. Additionally, without a wedge and barrel assembly, the tension cylinder is low profile and only protrudes from the bearing plate by about the width of the nut. This greatly increases the available area within the mine shaft.

The tensionable cable assembly also allows the bearing plate and washers if used and the tension nut to be assembled on site. The present invention does not require pre-assembly of the components due to the constant diameter of the tension cylinder. If desired, the bearing plate, washers if desired and tension nut can be assembled to the tensionable cable after the cable is installed into the borehole. This can be an advantage particularly when the it is desired to retrofit an existing installation.

The present invention provides a tensionable bolt cable system having a bearing plate having an opening and a first mating member adjacent the opening. A tension cylinder having a constant diameter throughout its length, with a proximal end and a distal end. The tension cylinder has a threaded exterior, a longitudinally extending second mating member extending at least partially the length of the tension cylinder and a proximal end having an angled interior surface for receipt of wedges to engage the cable. The first and second mating members are adapted to mate when the tension cylinder is inserted into the bearing plate.

A cable can be inserted into the tension cylinder and between the wedges. A tension nut is threaded onto the tension cylinder, wherein the nut is rotated against the bearing plate to tension the cable.

The invention also includes a method for installing a cable bolt into a mine shaft, the method including the steps of providing a constant diameter unitary tension cylinder having a proximal end and a distal end and a threaded exterior. A longitudinally extending first mating member extends at least partially the length of the tension cylinder. The proximal end has an angled interior surface adapted to receive wedges to hold a cable with respect to the tensionable cable, and wedges inserted into the angled interior surface.

A cable is inserted into the distal end of the tension cylinder and between the wedges. The wedges engage the cable to retain the cable with respect to the tension cylinder. A bearing plate with an opening and a second mating member adjacent the opening is also provided.

A borehole is drilled into a mine shaft and a resin cartridge is inserted. The tension cylinder is inserted into the bearing plate and the first and second mating members are mated to prevent rotation of the tension cylinder with respect to bearing plate. The cable is inserted into the borehole. The cable is rotated to rupture the resin cartridge and then the resin is allowed to set. Once set, the tension nut is rotated against the bearing plate to tension the cable.

DETAILED DESCRIPTION OF THE ENABLING EMBODIMENT

Figure 1:
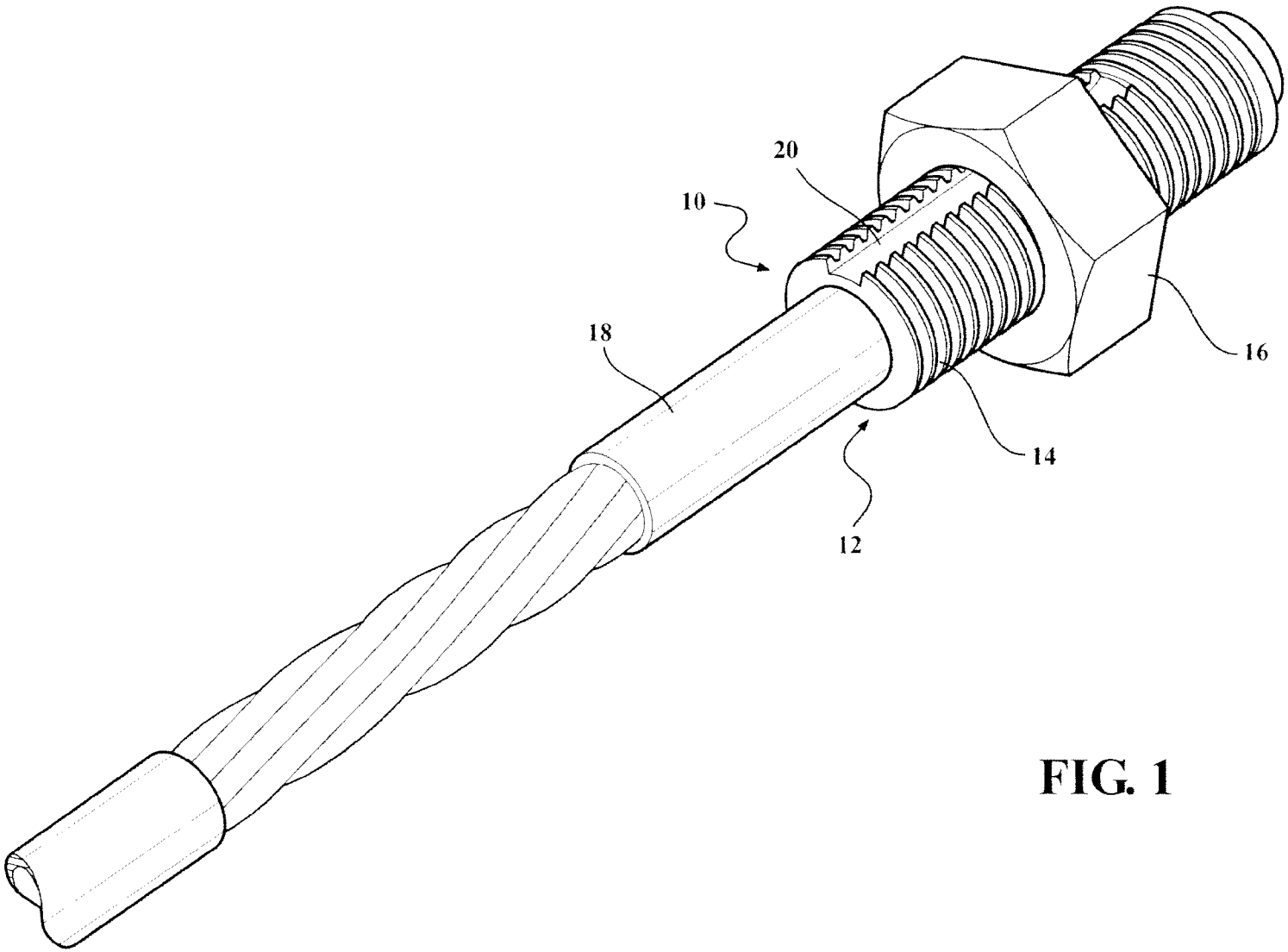
FIG. 1 is a perspective view of the tensionable cable bolt assembly of the present invention.
Figure 3:
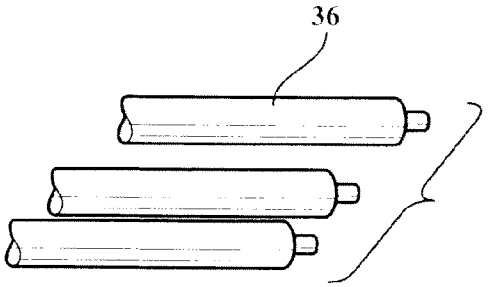
FIG. 3 is a partial perspective view of resin cartridges.
Figure 2:
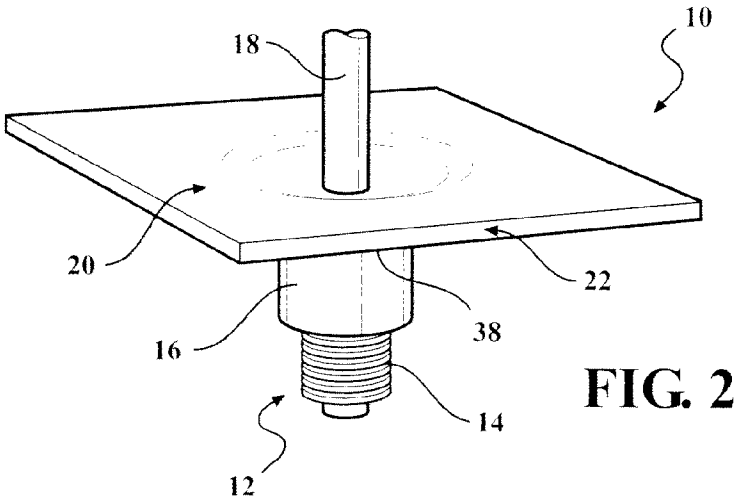
FIG. 2 is a perspective view of the tensionable cable bolt assembly and bearing plate of the present invention.
Figure 4:
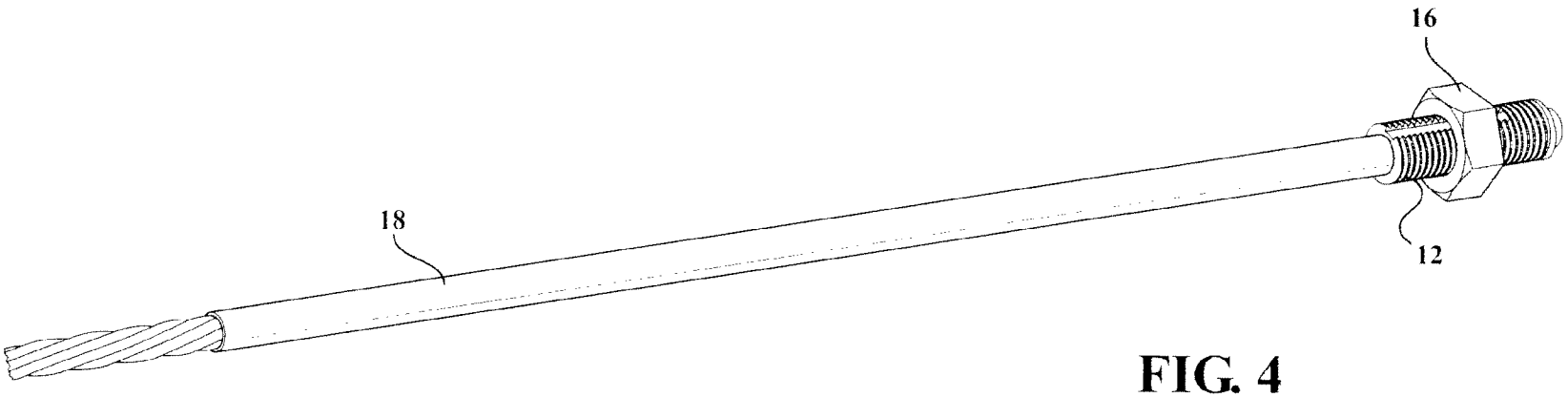
FIG. 4 is a perspective view of the tensionable cable bolt assembly of the present invention.
Figure 5:
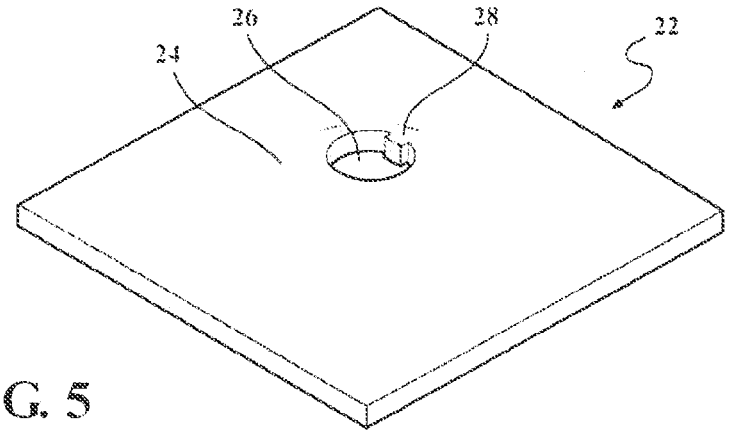
FIG. 5 is a perspective view of the bearing plate of the present invention.
Figure 6:
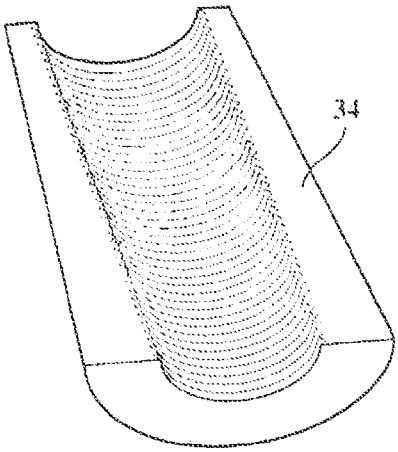
FIG. 6 is a perspective view of a wedge.
Figure 7:
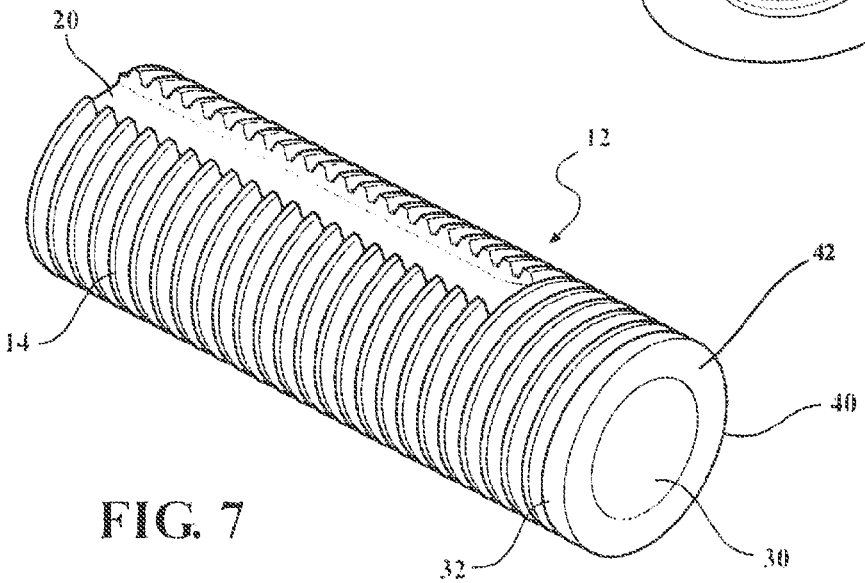
FIG. 7 is a perspective view of the tension cylinder of the present invention.
Figure 9:
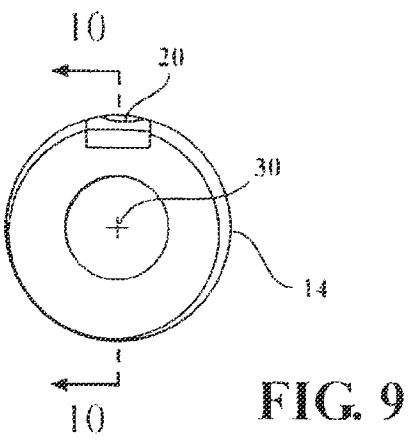
FIG. 9 is an end view of the tension assembly of the present invention.
Figure 11:
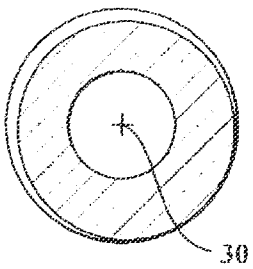
FIG. 11 is a cross-sectional view of the tension assembly of the present invention taken along line B-B of FIG. 10.
Figure 8:
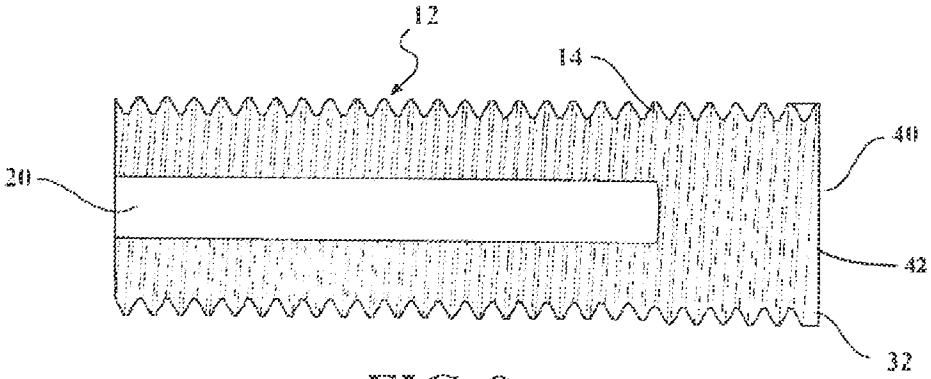
FIG. 8 is a side view of the tension assembly of the present invention.
Figure 10:
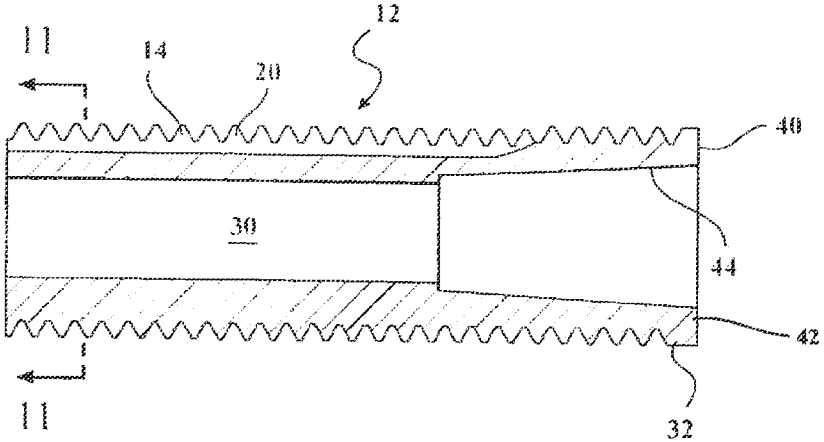
FIG. 10 is a cross-sectional view of the tension assembly of the present invention taken along line A-A of FIG. 9.
Figure 12:
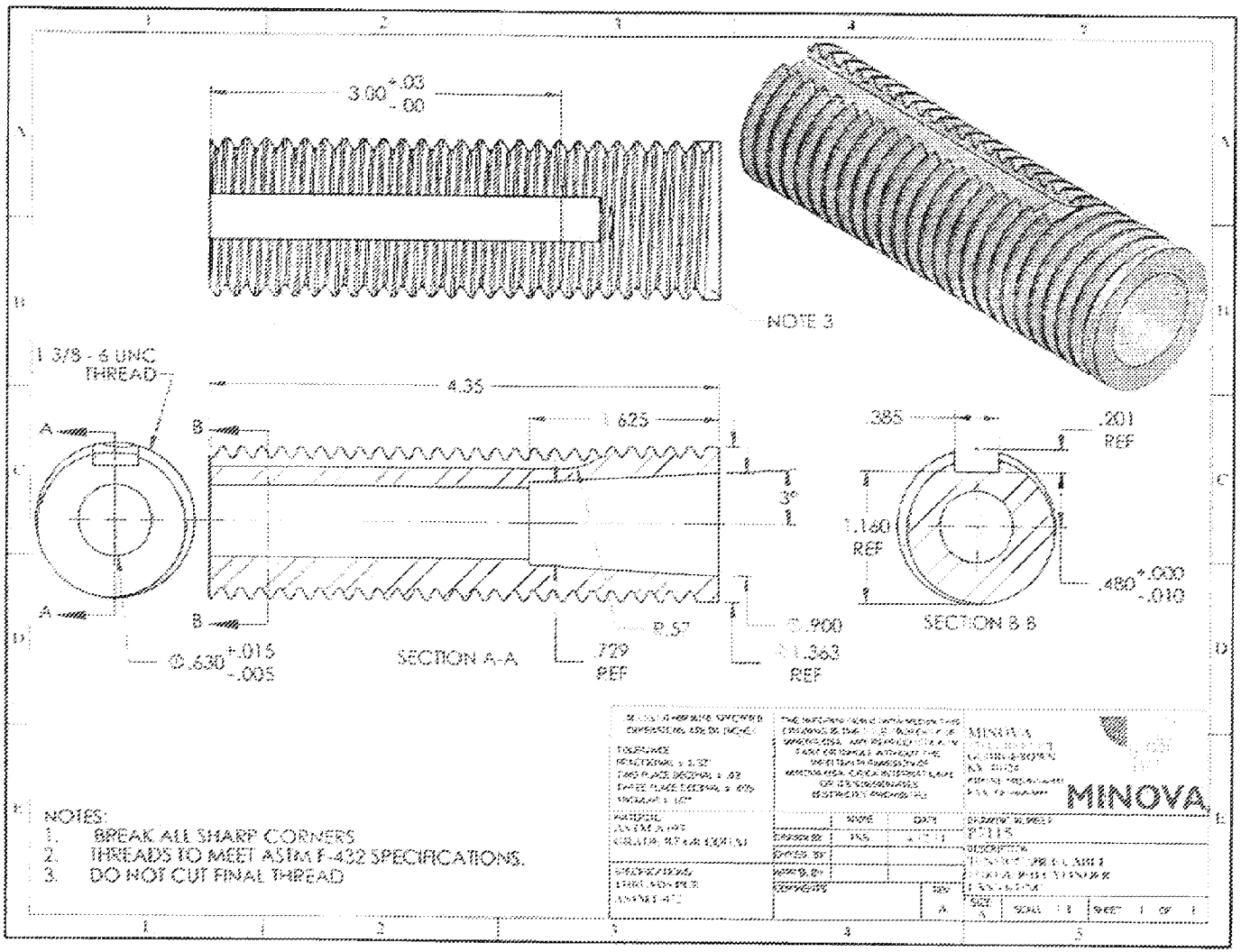
FIG. 12 is a detailed drawing of the tension cylinder of the present invention.
Figure 13:
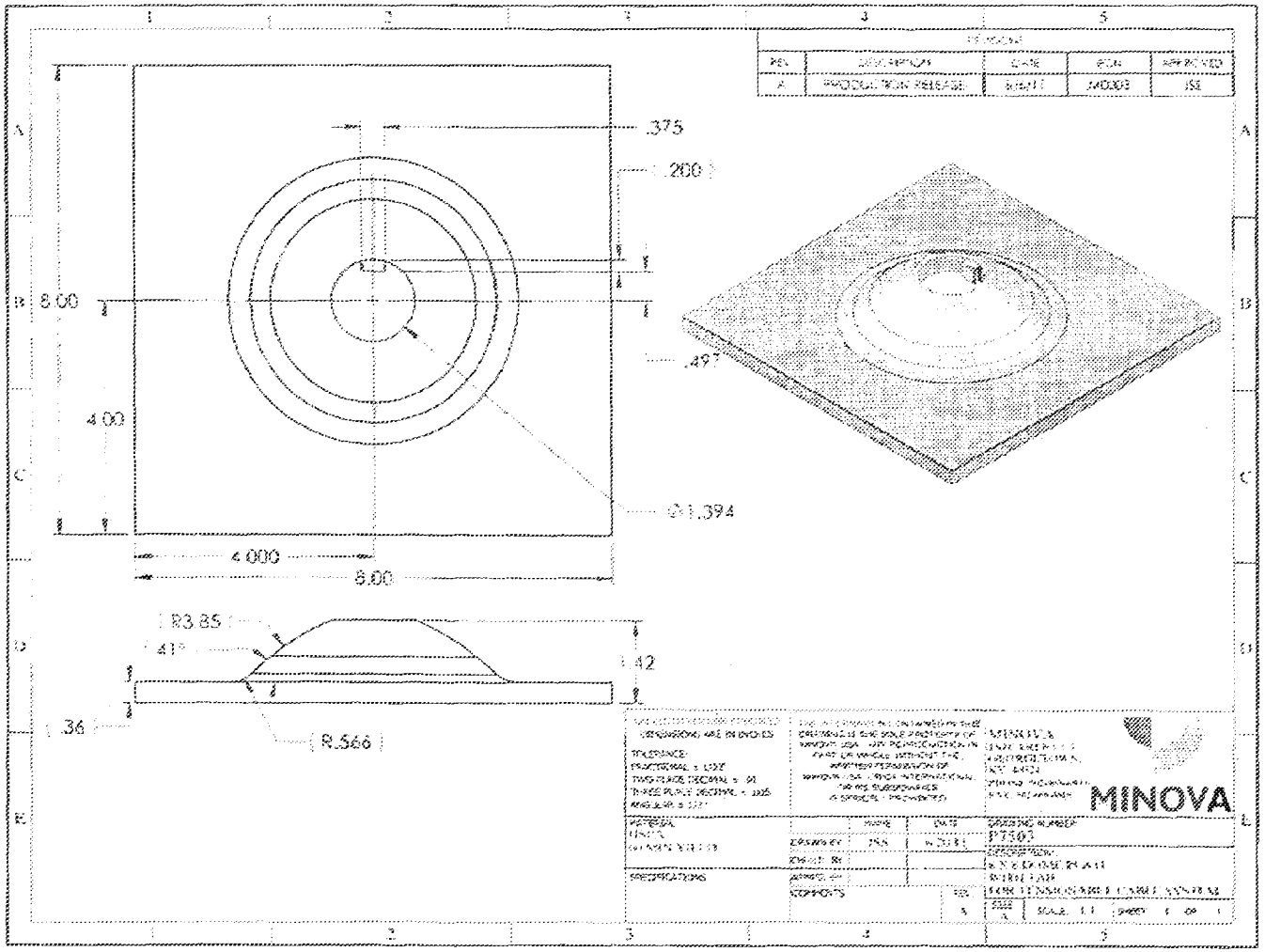
FIG. 13 is a detailed drawing of the bearing plate of the present invention.

The tensionable cable bolt system of the present invention is shown generally at 10 in the attached drawings. The tensionable cable bolt system 10 of the present invention has a tension cylinder 12 with external threads 14. In the disclosed embodiment, the threads are 1⅜ 6 UNC threads. It will be appreciated that other thread sizes may be used. The tension cylinder 12 has a proximal end 40 and distal end 42 and has a constant diameter between the proximal end 40 and distal end 42. In the disclosed embodiment, the cylinder 12 is made of steel. A nut 16 is adapted to thread onto the external threads to tension the cable 18.

A slot 20 is formed in the exterior of the cylinder 12. The slot 20 mates with a tab 28 formed in the bearing plate 22. As shown, the bearing plate 22 has a dome 24 and an opening 26. The opening 26 receives the cable 18. As will be appreciated by those of ordinary skill in the art, other plates can be used, the invention is not limited to a domed plate as disclosed. As will also be appreciated by those of ordinary skill in the art, the tab 28 could be formed on the cylinder 12 and the slot 20 formed on the plate 22. Additionally, other mating surfaces could be used, as for example flat surfaces, rounded surfaces, etc.

The cable 18 protrudes through the bore 30 of the cylinder 12 and has wedges 34 mounted on the ends of the cable 18. These wedges 34, there can be two to four wedges, are received in the proximal end 42 of the cylinder 12 and mate with the angled interior wall 44 of the cylinder 12. With the angled wall 44 and the angled exterior of the wedges 34, the cable 18 is captured and held in the cylinder 12. As the tension on cylinder 12 is increased, the force of the wedges 34 increases to engage and capture the cable 18.

In use, a borehole is drilled in the surface, such as the ceiling or wall of the mine shaft. This can be any diameter and depth, but the desired diameter is 1" to 1⅜". One or more resin cartridges 36 are inserted into the borehole. To insure that the resin cartridges 36 are properly inserted all the way to the top of the borehole before they are broken, the cartridge 36 is pushed into the borehole by the cable bolt 10. The cable bolt 10 is pushed to the top of the borehole.

The bearing plate 22 is positioned over the tension cylinder 12 and when it reaches within 1/16" to 1/8" of the roof or wall, the tension cable 10 is reverse spun to ensure complete mixing of the resin in the resin cartridge 36. In the disclosed embodiment, reverse spin is in the counterclockwise direction. The flat 32 on the tension cylinder 12 allows for reverse spinning of the cable bolt 10. It is typical to use a bolting machine in these operations. The bolting machine operatively engages the nut 16. Reverse rotation is then stopped and the bolt 10 is held for a specified time to allow the resin to cure.

The slot 20 of the tension cylinder 12 mates with the tab 28 of the plate 22 to prevent the cylinder 12 from rotating with respect to the plate 22.

Torque is then applied to the nut 16 with for example the bolting machine in accordance with approved control plan. The nut 16 is driven into the plate 22 to tension the cable 10. If desired, a hardened washer 38 can be positioned between the plate 22 and nut 16.

The cable bolt assembly of the present invention provides compression into the roof and ensures top to bottom tensioning of the cable 18, which places the anchorage higher in the roof structure to eliminate anchorage shock during loading.

The tensional cable bolt 10 of the present invention can be used for primary support and as secondary support in applications where traditional cable bolts are used and enhanced beam building is needed. Common application areas include tail gates, bleeder, recovery room, set-up room, head gates, intersections and other mine areas where longevity and additional support is required.

The present cable bolt system uses existing equipment and provides enhanced beam building with tension up to 15000 pounds. It can be used as primary support and installed right after mining. It reduces secondary support and reduces or eliminates the need for expensive cribbing and standing supports. It is available in long one-piece bolts for any seam height. It lowers cost by allowing the installation during normal bolting operations and strengthens and reinforces roof supports.

The present system provides a very low profile which protrudes only a small distance from the roof or wall. This allows for more clearance room than traditional cable bolts.

What is claimed is:

1. A tensionable bolt cable system comprising:

a bearing plate having an opening and a first mating member adjacent said opening, a tension cylinder having a proximal end and a distal end, an internal bore extending from the proximal end to the distal end and having an angled interior surface adjacent the proximal end, a longitudinally extending second mating member extending at least partially the length of said tension cylinder, an external thread formed on a portion of the tension cylinder, and a nut engaging member adjacent the proximal end of the tension cylinder, said first and second mating members are adapted to mate when said tension cylinder is inserted through the opening in said bearing plate, angled wedges that are to be inserted into said angled interior surface, a cable adapted to be inserted into the internal bore of said tension cylinder and between said wedges, said wedges being configured to engage said cable to hold said cable with respect to said tension cylinder, and a nut adapted to be threaded onto said tension cylinder between the bearing plate and the distal end, the nut being rotatable on the external thread in a first direction towards the distal end, and when the nut is in engagement with the nut engaging member rotation of the nut in a second direction causes said tension cylinder and cable to rotate with the nut, wherein said nut is rotatable against said bearing plate to tension said cable.

2. The tensionable bolt cable system of claim 1, wherein the nut engaging member includes a flat portion immediately adjacent to said proximal end of said tension cylinder.

3. The tensionable bolt system of claim 2, wherein the nut engaging member includes a cylindrical portion of the tension cylinder adjacent said external thread.

4. A tensionable bolt cable assembly comprising:

a tension cylinder having a proximal end and a distal end, an internal bore extending from the proximal end to the distal end and having an angled interior surface adjacent the proximal end that is adapted to receive wedges to hold a cable with respect to said tension cylinder, a longitudinally extending mating member extending partially the length of said tension cylinder, an external threaded formed on a portion of the tension cylinder, and a nut engaging member adjacent the proximal end of the tension cylinder.

5. The tensionable bolt cable assembly of claim 4, further including a bearing plate having an opening and a complimentary mating member adjacent said opening adapted to mate with said longitudinally extending mating member, whereby when said longitudinally extending mating member is mated to said complimentary mating member said tension cylinder is rotationally fixed with respect to said bearing plate.

6. The tensionable bolt cable assembly of claim 4, further including two or more angled wedges that are adapted to be inserted into the angled interior surface so as to engage a cable inserted through the internal bore and between said wedges.

7. The tensionable bolt cable assembly of claim 4, further including a nut adapted to be threaded onto said tension cylinder, wherein said nut is rotatable on the external thread in a first direction towards the distal end, and when the nut is in engagement with the nut engaging member rotation of the nut in a second direction causes said tension cylinder to rotate with the nut.

8. The tensionable bolt cable assembly of claim 4, wherein the nut engaging member includes a flat portion immediately adjacent to said proximal end of said tension cylinder.

9. The tensionable bolt cable assembly of claim 4, wherein the nut engaging member includes a cylindrical portion immediately adjacent to said proximal end of said tension cylinder.

10. A method for installing a cable bolt into a borehole, said method including the steps of:

providing a tensionable bolt cable system according to claim 1;

threading the nut onto the external thread from the distal end of the tension cylinder, inserting said tension cylinder through the opening in said bearing plate and mating said first and second mating members to prevent rotation of said tension cylinder with respect to said bearing plate, inserting said cable through the internal bore, and inserting said angled wedges into the angled interior surface and around said cable.

11. The method of claim 10, further including the step of inserting the cable into the borehole.

12. The method of claim 11, further including, inserting a resin cartridge into said borehole before inserting said cable into said borehole, rupturing said resin cartridge, and holding said cable until said resin sets and retains said cable in said borehole.

13. The method of claim 12, further including positioning the nut in engagement with the nut engaging surface, and rotating said nut in the second direction to rotate said cable within said borehole to mix contents of said resin cartridge.

14. The method of claim 13, further including the step of rotating said nut in the first direction to thread said nut along said external thread against said bearing plate to tension said cable.

* * * * *